US011819101B2

(12) United States Patent
Marron

(10) Patent No.: US 11,819,101 B2
(45) Date of Patent: Nov. 21, 2023

(54) MULTICOMPARTMENT HANDBAG

(71) Applicant: Future Collective, Inc., Incline Village, NV (US)

(72) Inventor: Andrea Marron, Incline Village, NV (US)

( * ) Notice: Subject to any disclaimer, the term of this patent is extended or adjusted under 35 U.S.C. 154(b) by 37 days.

(21) Appl. No.: 17/522,799

(22) Filed: Nov. 9, 2021

(65) Prior Publication Data

US 2022/0142318 A1 May 12, 2022

Related U.S. Application Data

(60) Provisional application No. 63/113,172, filed on Nov. 12, 2020.

(51) Int. Cl.

| | |
|---|---|
| ***A45C 13/02*** | (2006.01) |
| ***A45C 11/00*** | (2006.01) |
| ***A45C 5/02*** | (2006.01) |
| ***A45C 7/00*** | (2006.01) |
| ***A45C 5/08*** | (2006.01) |

(52) U.S. Cl.

CPC ..... *A45C 13/02* (2013.01); *A45C 5/02* (2013.01); *A45C 5/08* (2013.01); *A45C 7/0054* (2013.01); *A45C 11/00* (2013.01); *A45C 2011/002* (2013.01)

(58) Field of Classification Search

CPC .. A45C 13/02; A45C 5/02; A45C 5/08; A45C 7/0054; A45C 11/00; A45C 2011/002

See application file for complete search history.

(56) References Cited

U.S. PATENT DOCUMENTS

| | | | | |
|---|---|---|---|---|
| 677,942 | A * | 7/1901 | Christie | A45C 13/02 190/114 |
| 792,183 | A * | 6/1905 | Tiderman | A45C 3/00 190/114 |
| 2,055,657 | A | 1/1932 | Gordon | |
| 3,459,327 | A | 8/1969 | Harris | |
| 6,644,448 | B2 * | 11/2003 | Bernbaum | A45C 7/0054 190/114 |
| 7,204,398 | B1 | 4/2007 | Smith, Sr. | |
| 7,380,686 | B1 | 6/2008 | Friedman et al. | |
| 7,900,757 | B2 * | 3/2011 | Sisitsky | A45C 11/20 190/110 |
| 8,584,847 | B2 * | 11/2013 | Tages | G06F 1/1633 206/320 |
| 9,265,316 | B2 * | 2/2016 | Diaz | A45C 3/06 |
| 9,277,804 | B1 | 3/2016 | Gennodie | |
| 9,287,722 | B2 * | 3/2016 | Williams | H02J 7/0013 |
| 9,398,793 | B2 | 7/2016 | Marin | |

(Continued)

*Primary Examiner* — Tri M Mai

(74) *Attorney, Agent, or Firm* — McConnell Law Firm PC; Robert McConnell

(57) ABSTRACT

A unique and useful configuration for a multicompartment handbag that opens in a unique way displaying an interior with useful compartments and a shelf sized for a smart phone. When closed, the multicompartment handbag has a pleasing visual aesthetic with exterior panels manufactured from unique, functional, and varied materials such as wood, various plastics including Lucite and resin, leather, leather alternatives such as mushroom or grape leather, and various metals. Pieces or panels of the handbag are cut with a CNC cutting machine but many other manufacturing methods are anticipated.

19 Claims, 7 Drawing Sheets

(56) References Cited

U.S. PATENT DOCUMENTS

| | | | | |
|---|---|---|---|---|
| 9,986,800 | B1 | 6/2018 | Robinson | |
| 10,136,711 | B2 | 11/2018 | Levinson | |
| 10,561,212 | B2 | 2/2020 | Ho | |
| 10,681,970 | B2 | 6/2020 | McManus | |
| 10,750,836 | B2 * | 8/2020 | Caroli ..... | H02J 50/10 |
| 2002/0023812 | A1 | 2/2002 | Bernbaum et al. | |
| 2014/0367004 | A1 | 12/2014 | Miki | |
| 2016/0286924 | A1 | 10/2016 | Groover | |
| 2017/0095065 | A1 | 4/2017 | Colbert et al. | |
| 2018/0020793 | A1 | 1/2018 | Rao et al. | |
| 2018/0020794 | A1 | 1/2018 | Rao | |
| 2019/0133281 | A1 | 5/2019 | Munie et al. | |
| 2019/0246761 | A1 | 8/2019 | Tibbs-Mackey | |
| 2020/0093235 | A1 | 3/2020 | Quesnel | |
| 2021/0196017 | A1 | 7/2021 | Goodison | |

* cited by examiner

MULTICOMPARTMENT HANDBAG

BACKGROUND OF THE INVENTION

Field of the Invention

The field of this invention is handbags and/or luggage to carry various personal items. Handbags and hand carried luggage have been well known in the art for centuries, however existing configurations have a number of functional and aesthetic issues. One of the primary existing issues is easy, quick access to important items in the handbag or luggage, especially mobile phones. Handbag configurations that exist in the art prior to the described invention have large compartments where items get lost requiring the user to search within the compartment to find the item, or have been designed for mobile phones but do not have adequate storage for other items such as keys, money, credit cards, sunglasses, make up, tissues and many other personal items often found in a handbag.

The present invention is directed toward handbags or hand luggage with a base, a clamshell top and various internal compartments design to hold specific items. The present invention relates to handbags and/or hand luggage manufactured in various exterior materials such as wood, leather, lucite, plastics, resins, "vegan" leather such as mushroom/grape leather, and various metals. Structural materials include lucite, plastic, wood and metal. Ornamentation can be added made with any suitable materials such as leather, metals, precious metals, velvet, fabrics, decorative stones and costume jewels. Manufacturing methods include traditional hand cutting and sewing, CNC cutting/computer manufacturing, laser cutting and any other suitable manufacturing method known in the art.

Description of Background Art

The background art contains many variations of handbags and hand carried luggage that contain compartments for mobile phones and/or various items.

U.S. Pat. No. 7,204,398 is a folding wallet with special section for a mobile phone in its center pouch. The patent describes this wallet as having three folding sections with hinges.

U.S. Pat. No. 9,265,316 describes a handbag with mobile phone storage at base. This patent describes two folding clamshells with storage in the clamshells.

U.S. Pat. No. 9,398,793 describes a clamshell handbag with mobile phone holder on its exterior. It further describes a hinged plate is hinged to allow use separate from clamshell compartment. The disclosed clamshell is hinged and has a clasp at top.

U.S. Pat. No. 10,136,711 shows clamshell purse with metal exterior that is constructed to allow mobile phone reception in its interior. Hinged clamshells with a clasp are included in the disclosure.

U.S. Pat. No. 10,561,212 describes laptop/mobile phone case with hinged, folding and clasped closures.

OBJECTS OF THE INVENTION

It is an object of the invention to provide a multicompartment handbag.

It is an object of the invention to provide a multicompartment handbag with a base and two hinged clamshells to access the interior of the handbag.

It is an object of the invention to provide a multicompartment handbag with interior compartments inside the hinged clamshells.

It is an object of the invention to provide a multicompartment handbag with a support for a mobile phone in the interior compartment.

It is an object of the invention to provide a multicompartment handbag with pockets on the interior of the clamshells.

It is an object of the invention to provide a multicompartment handbag with manufactured with various exterior materials including leather, leather alternatives, woven leather, wood (of many varieties, patterned or solid), plastic (both new and recycled), Lucite, acrylic (clear, patterned or colored), resin, metal, washi paper, other papers, shearling, enamel, aerospace grade aluminum, exotic skins such as alligator, and rattan.

It is an object of the invention to provide a multicompartment handbag with manufactured with various base materials such as wood, plastic, metal and lucite.

It is an object of the invention to provide a multicompartment handbag with manufactured with various interior materials such as leather, suede, velvet, fabric, micro suede, microfiber, alcantara, or plastic.

It is an object of the invention to provide a multicompartment handbag manufactured with a CNC cutting machine.

It is an object of the invention to provide a multicompartment handbag manufactured with laser cutting.

It is an object of the invention to provide a multicompartment handbag manufactured with 3D printing.

It is an object of the invention to provide a multicompartment handbag with a battery installed in the interior compartment.

SUMMARY OF THE INVENTION

The present invention is a unique and useful configuration for a multicompartment handbag. The present invention opens in a unique way displaying an interior with a number of useful compartments and a shelf sized for a smart phone. When closed, the multicompartment handbag has a pleasing visual aesthetic with exterior panels manufactured from unique, functional and varied materials such as wood, various plastics including Lucite and resin, leather, leather alternatives such as mushroom or grape leather, and various metals.

In the preferred embodiment of the multicompartment handbag, the pieces or panels of the handbag are cut with a CNC cutting machine but many other manufacturing methods are anticipated.

DESCRIPTION OF THE PREFERRED EMBODIMENT

The present invention is a multicompartment handbag that is built in a useful and unique configuration. The configuration includes two opening clamshells and a base. The interior of the multicompartment handbag includes two opening and closing compartments, two document sleeves and a ledge sized to hold a typical smart phone. The exterior of the handbag can be manufactured out of a number of unique exterior materials, including wood, various plastics including patterned Lucite and resin, leather and various metals. While the disclosure is drawn to describe the preferred embodiment, many other embodiments are anticipated that are consistent with this disclosure.

Figure 1:
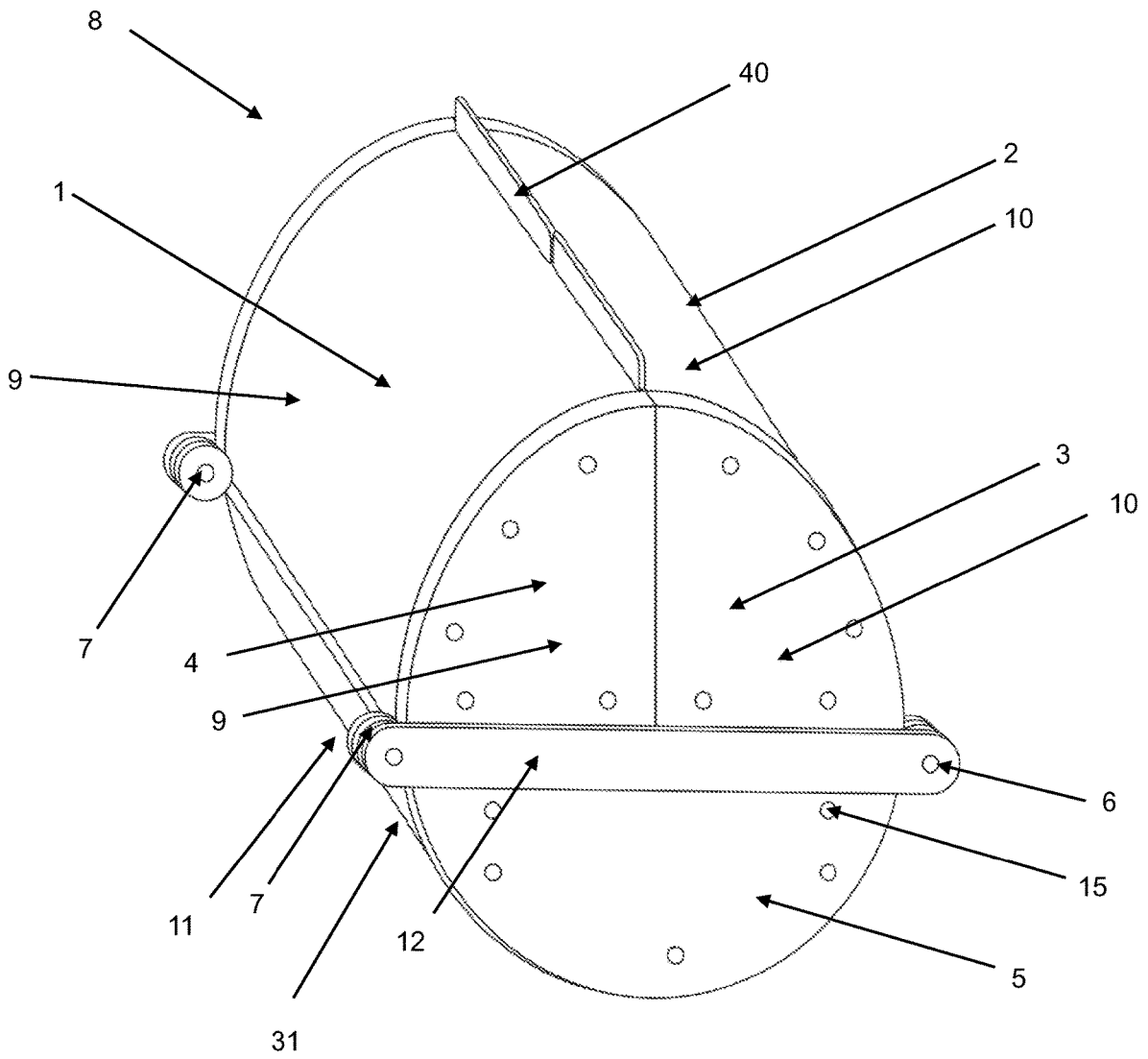
FIG. 1 is a view of the exterior of the multicompartment handbag.

FIG. 1 shows a diagram of the multicompartment handbag 8 with all its constituent parts, in a closed state. The multicompartment handbag 8 consists of a first clamshell 1, second clamshell 2 and base 11. First clamshell 1 is connected to base 11 at first hinges 7, with one hinge located at each end of the first clamshell 1. First hinge 7 allows first clamshell 1 to rotate around the hinge, which in turn allows the first clamshell to open and close. Second clamshell 2 is connected to base 11 at second hinge 6, also with one hinge located at each end of second clamshell 2. As with first clamshell 1, second clamshell 2 rotates around each hinge, allowing second clamshell 2 to open. First clamshell 1 and second clamshell 2 open and close independently and allow access to the interior of the multicompartment handbag 8. In the preferred embodiment, magnets are embedded in the panels that hold the clamshells closed, but other arrangements are possible such as latches and clasps. Latch 40, as shown in FIG. 1, has two halves that latch together to keep first clamshell 1 and second clamshell 2 closed. One half of latch 40 is attached to the top of first clamshell 1 and a second half of latch 40 is attached to the top of second clamshell 2. When the two halves of the latch 40 couple, they hold first clamshell 1 and second clamshell 2 closed.

First clamshell 1 comprises a first clamshell end 4 located at each end of the clamshell and is covered by a first clamshell exterior material 9. In the preferred embodiment, each first clamshell end 4 has a right angle at one end with a curved surface opposite the right angle. Second clamshell 2 comprises a second clamshell end 3 located at each end of the clamshell and is covered by a second clamshell exterior material 10. Each second clamshell end 3 has a right angle at one end and a curved surface opposite the right angle.

Base 11 is comprised of a base end 5 at each end and a base exterior material 31. In the preferred embodiment, base end 5 is a semi-circular shape with a flat edge on one side and a curved edge opposite the flat edge and forming an arch between the two ends of the flat edge. Base 11 includes an interior compartment designed for storage of items within the multi-compartment handbag 8. Hinge bar 12 is located along the flat edge of base 11 and locates both first hinge 7 and second hinge 6. A duplicate base 11, hinge bar 12, first hinge 7 and second hinge 6 are located at the other end of the multicompartment handbag. A hinge bar 12 is shown in the preferred embodiment, but the hinges could be attached directly to the bag in an alternate embodiment. In FIG. 1, rivets 15 are shown as an attachment method for the various parts of the handbag. These rivets 15 are included in some embodiments and not included in others depending on the construction method and aesthetic considerations.

The individual parts of the multicompartment handbag, particularly first clamshell 1, second clamshell 2, base 11, hinge bar 12, and all their constituent parts can be cut/formed by using a variety of methods, including by hand, human operated lathes or mills, human operated tools such as drills and/or saws, CNC cutting, laser cutting, molding, casting and 3D printing. Molds of the exterior parts can be manufactured by 3D printing as well, so that metal/plastic parts can be cast in them. Cutting materials by hand is a traditional method performed by craftspeople. This method results in a beautiful hand-crafted end product but is time consuming and expensive. The group of skilled artisans that can perform this sort of detailed work is a small group and thus command significant cost for their time.

CNC (or computer numerical control) machines use a variety of cutting means controlled by a computer for precision cuts. The cutting implement is secured on a motorized and maneuverable platform (also known as a chuck, spindle, turret or tool holder depending on the type of cutting tool) that is controlled by a computer. The computer can maneuver the cutting implement along the X, Y and Z axes, independently, to manage nearly any cut.

The dimensions and design of the parts to be cut are fed into the computer, often through computer aided design (CAD) software. These tools are generally 100% controlled by computer and do not require human assistance at the machine to perform their work. CNC cutting tools have become quite sophisticated, allowing modeling of cuts prior to starting the process to avoid manufacturing problems.

CNC tools can be used with a great many different cutting, forming and joining tools including drills, embroidery machines, lathes, milling machines, wood routers, punches, bending machines, plasma cutters, laser cutters, sewing machines, vinyl cutters and many others well known in the art. The preferred embodiment of this invention requires the use of CNC cutting machines and a combination of drills, routers and laser cutters are used depending on the material used for the handbag.

Additionally, some versions of the bag will be covered with a flat piece of metal or hard wood that is either laser cut or cut by a CNC device with a pattern that forms "flexure" using a "kerfing" technique. The pattern cut into the exterior material with this method forms a natural curve that is easily bent around the exterior of the bag.

In the preferred embodiment of the invention, the metal parts of the bag, including the hardware, latches and other metal trim, are cut using a CNC machine. The cut metal pieces are then galvanized, or other methods of treating the metal and/or applying a finish are used such as anodization or PVD coating (physical vapor deposition). The structural materials of the multicompartment handbag such as the base 11, first clamshell 1 and second clamshell 2 are 3D printed and then wrapped in either leather or suede.

Figure 2:
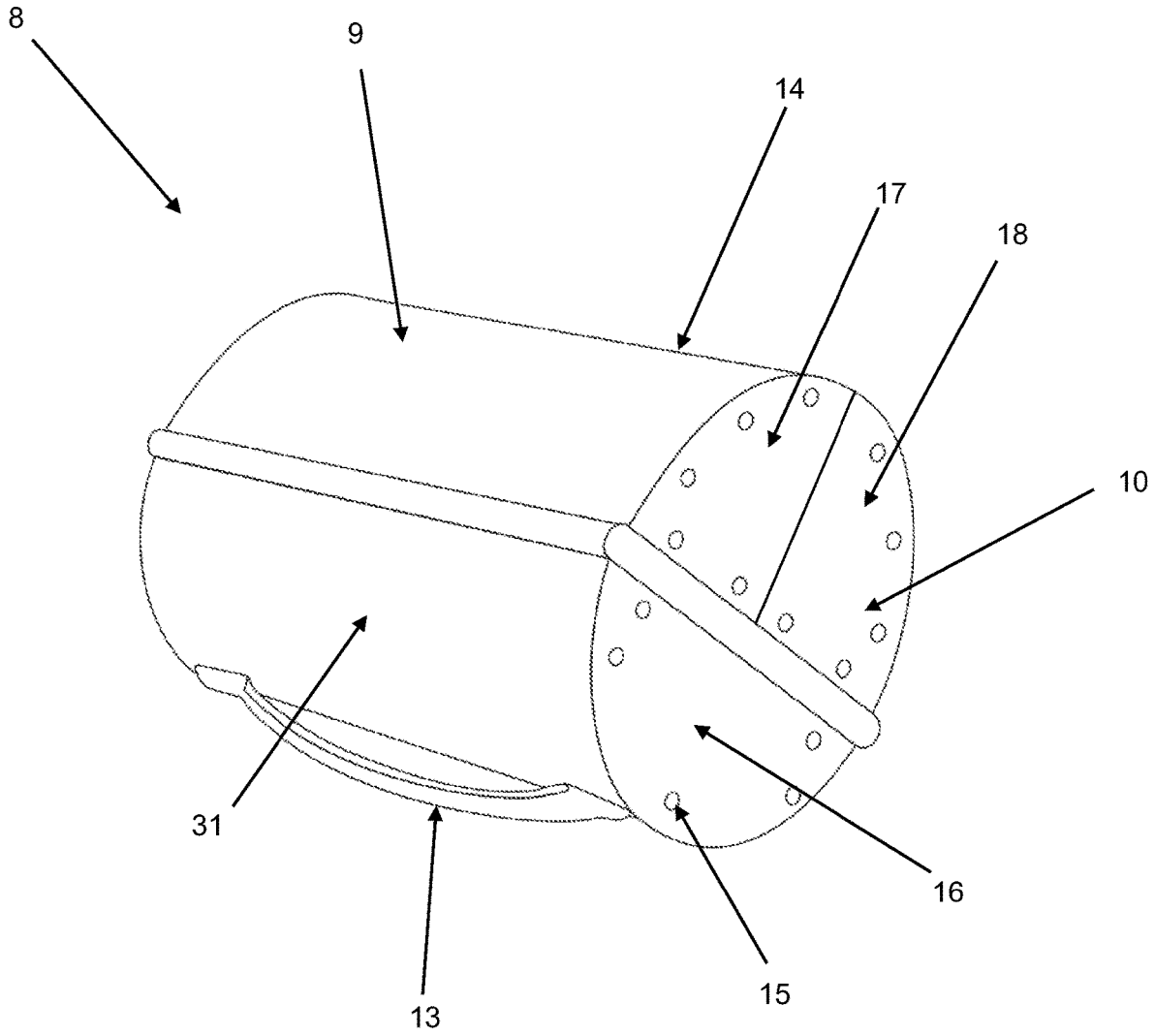
FIG. 2 is an alternate view of the exterior of the multicompartment handbag.

FIG. 2 shows the exterior of finished multicompartment handbag 8. In addition to the unique and useful features of the multicompartment handbag 8, the ability to use varied and unique exterior materials, adds additional utility and aesthetic design to the bag. First clamshell material 9, second clamshell material 10 and base material 31 cover the first clamshell 1, second clamshell 2 and base 11 respectively. First clamshell end material 17, second clamshell end material 18 and base end material 16 cover first clamshell end 4, second clamshell end 3 and base end 5 respectively. Also displayed in FIG. 2 are handle 13, clamshell trim 14 and rivets 15.

A variety of exterior materials are anticipated and can be used for the bag including leather, leather alternatives, woven leather, wood (of many varieties, patterned or solid), plastic (both new and recycled), Lucite, acrylic (clear, patterned or colored), resin, metal, washi paper, other papers, shearling, enamel, aerospace grade aluminum, exotic skins such as alligator, and rattan. Stronger materials like wood, Lucite, acrylic or metal can be both the exterior material and the base material for the clamshells, ends and base. In the alternative, materials like leather, or thinner patterned wood, acrylic or metal can be used solely as an exterior material over a base material such as wood or plastic. The base material provides durability and support for the handbag and the exterior material provides unique decoration. The material shown in FIG. 2 is leather stretched over a wood base material.

Figure 3:
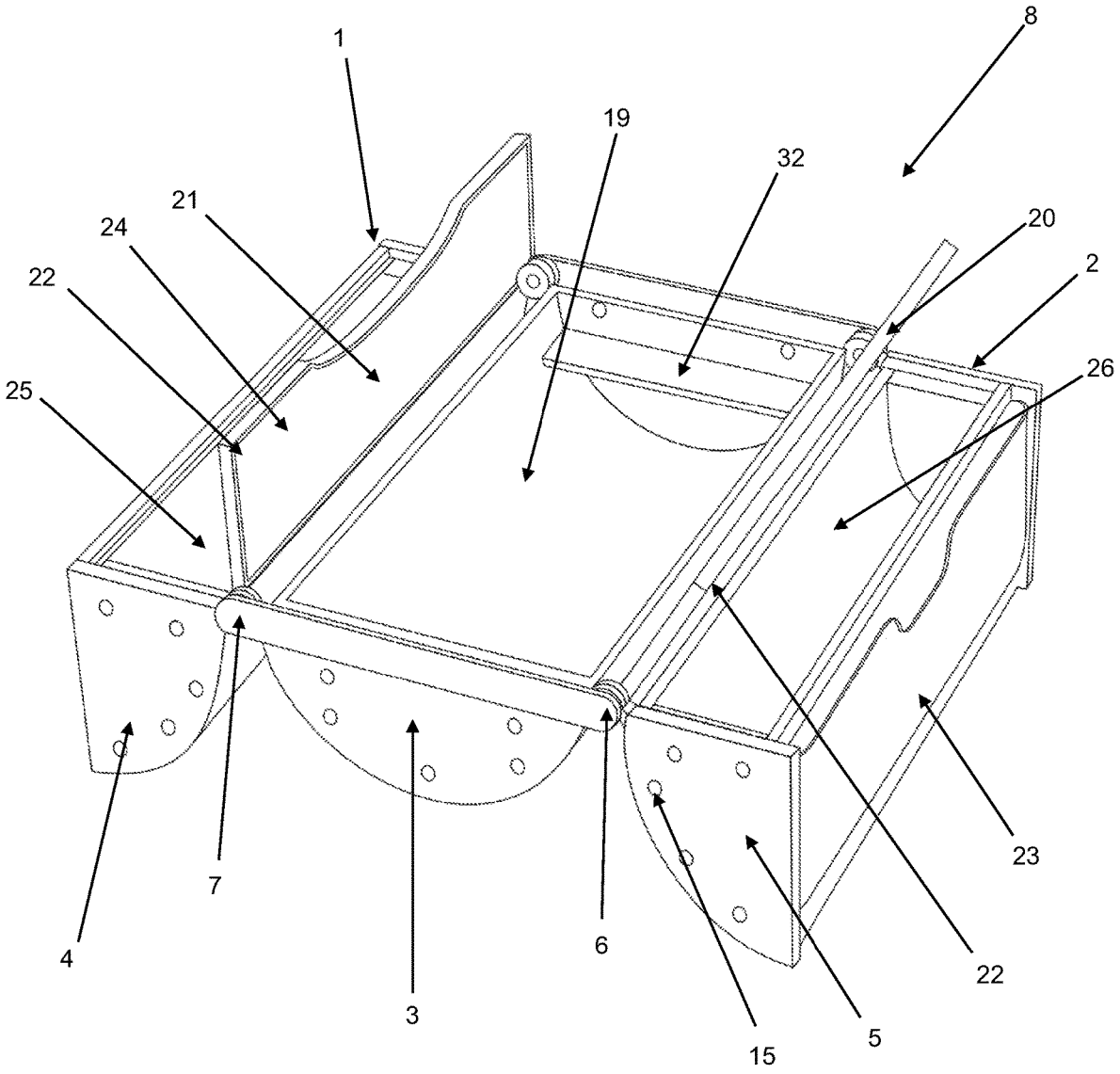
FIG. 3 is a view of the interior of the multicompartment handbag with the clamshells open.

FIG. 3 shows a diagram of the multicompartment handbag 8 open to show the features of the interior of the bag. Base compartment 19 is shown with phone rails 32. Phone rails 32 are located on either side of the base compartment 19 and sized such that a typical smart phone such as an iPhone or Android will fit with the sides supported by phone rails 32. Phone rails 32 can be placed on either side of the handbag or at the top and bottom of the handbag as shown in FIG. 3. First compartment door 21 is shown on first clamshell 1. Second compartment door 20 is shown in second clamshell 2. These doors open and close to expose an internal compartment, one on each of the clamshells. Compartment door latches 22 on each side allow the compartment doors to be latched shut. Compartment doors are shown opening outwardly in this view, but other opening directions are anticipated by the invention. In the preferred embodiment, this is a standard snap device or a magnet, depending on the configuration, but many other latches are anticipated and known in the art.

Clamshell sleeve 23 is also shown. This easily accessible compartment is suitable for storing credit cards, cash, papers, receipts, identification or other flat and thin items that need to be kept readily at hand. The clamshell sleeves 23 are oriented such that when the clamshell is open, the sleeve is open upward thus preventing items from falling out. Clamshell sleeve 23 is shown in this location in this view, but it is anticipated that it could be placed in many other locations (such as inside the base compartment 19 or the interior compartments) and sized to hold other, larger items such as passports. In the preferred embodiment, clamshell sleeves 23 are made of clear plastic, but many other suitable materials are anticipated such as leather, cloth, fabric, suede and micro suede. The interior of the bag is covered in interior material 24. This material could be leather, suede, velvet, fabric, micro suede, microfiber, alcantara, plastic or any number of other suitable materials known in the art, and in the preferred embodiment, micro suede.

Figure 4:
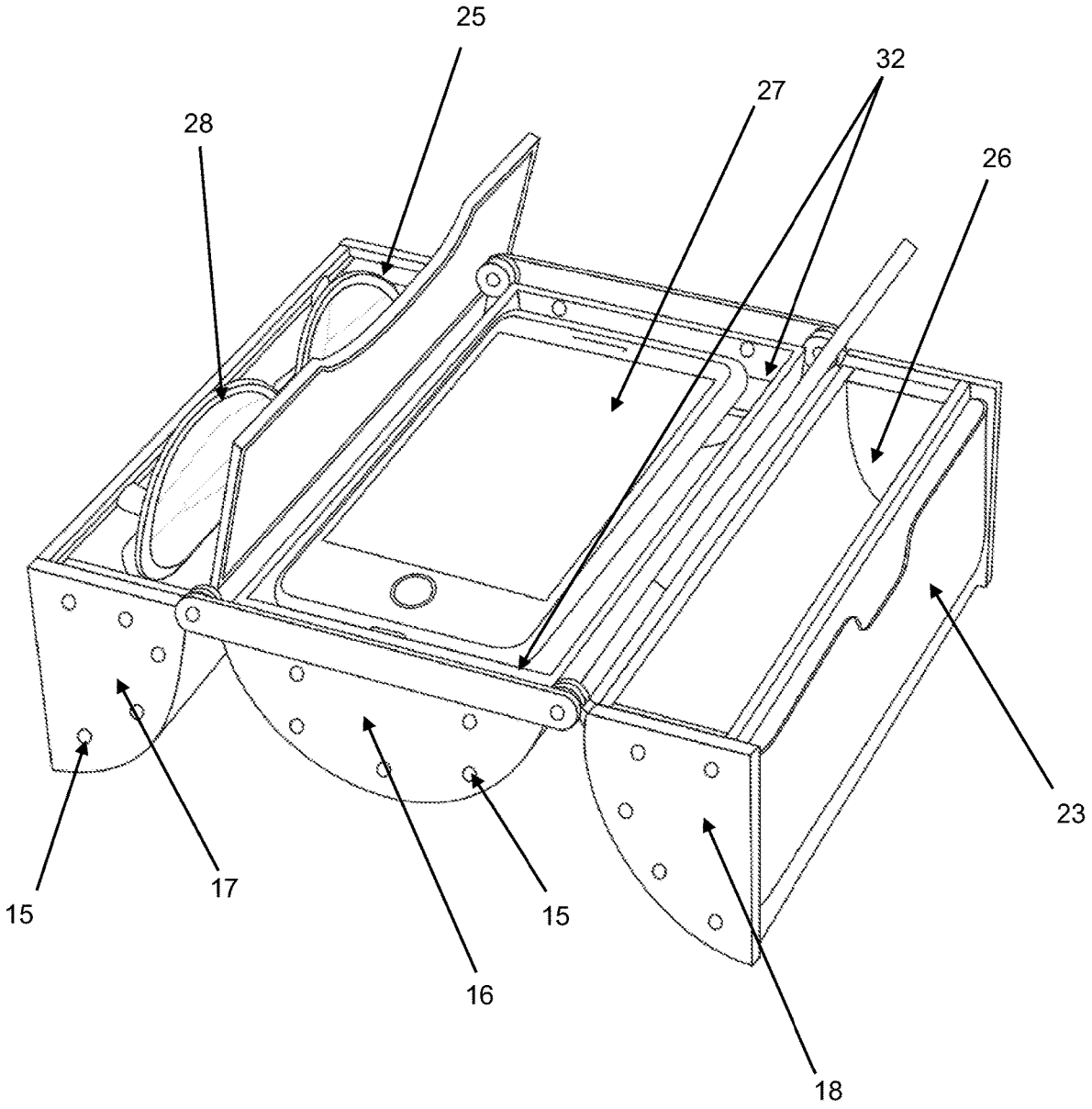
FIG. 4 is a view of the interior of the multicompartment handbag with the clamshells open and a phone on the phone rails.

FIG. 4 further shows the multicompartment bag 8 with first compartment door 21 and second compartment door 20 open with first interior compartment 25 and second interior compartment 26 visible. First compartment door 21 and second compartment door 20 are attached to the bag using standard hinges so they can open and close easily. Smart phone 27 is shown situated on phone rails 32. Sunglasses 28 are shown stored in second interior compartment 26.

Rivets 15 are shown and in this embodiment made of bright metal. While rivets 15 are shown in this embodiment, many other attachment methods can be used for the constituent parts of the bag including screws, glue, thermal glue, tape, welding, and soldering. First clamshell end material 17, second clamshell end material 18 and base end material 16 are shown and in this embodiment formed of leather over a wood base.

Figure 5:
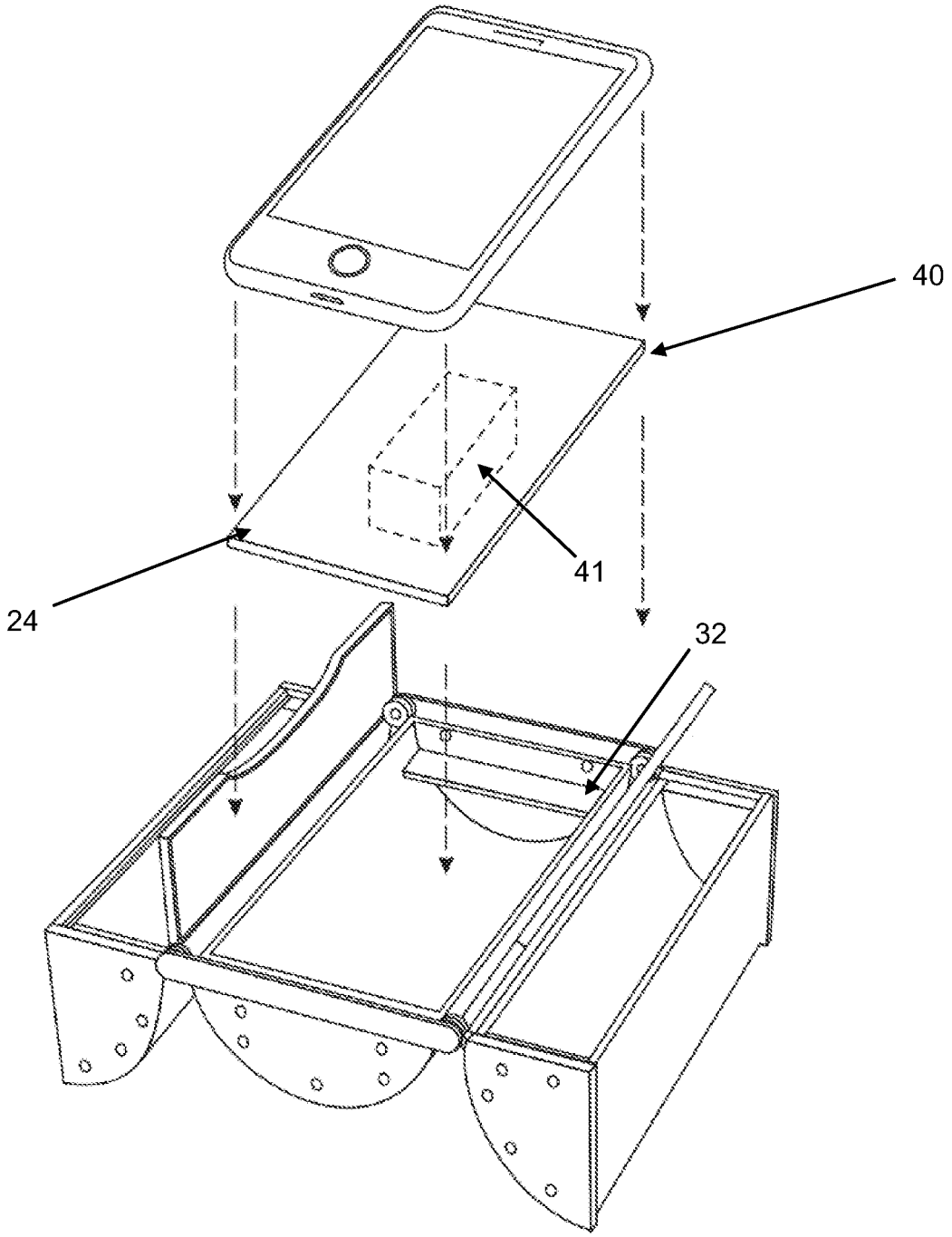
FIG. 5 is a view of the interior of the multicompartment handbag with the phone bed and battery shown.

FIG. 5 shows an alternate embodiment with a phone bed 40 and battery 41. Phone bed 40 is shaped to fit on and be supported by phone rails 32. Phone bed 40 provides a removeable support on which a user may place their smart phone. The phone bed is made from a base material similar to the bag, specifically plastic, wood, aluminum or other metals cut into the correct shape as described earlier in the disclosure. The base material is wrapped in the same interior material 24 as the rest of the bag. Battery 41 may be attached to the underside of phone bed, or in embodiments that do not include phone bed 40, the interior of the base or either clamshell. Battery 41 provides electrical power for devices such as smart phones or other small devices that fit in the bag. Battery 41 can be attached to phone bed or in any other location by glue, tacking, screws, clips and other suitable attachment methods well known in the art. Battery can be attached to the user's smart phone via a cable (USB, USB-C, Thunderbolt and others well known in the art) or using wireless charging technologies such as Qi, PMA or MagSafe. Battery 41 is constructed using standard battery technologies like lithium ion in the preferred embodiment or nickel cadmium.

Figure 6:
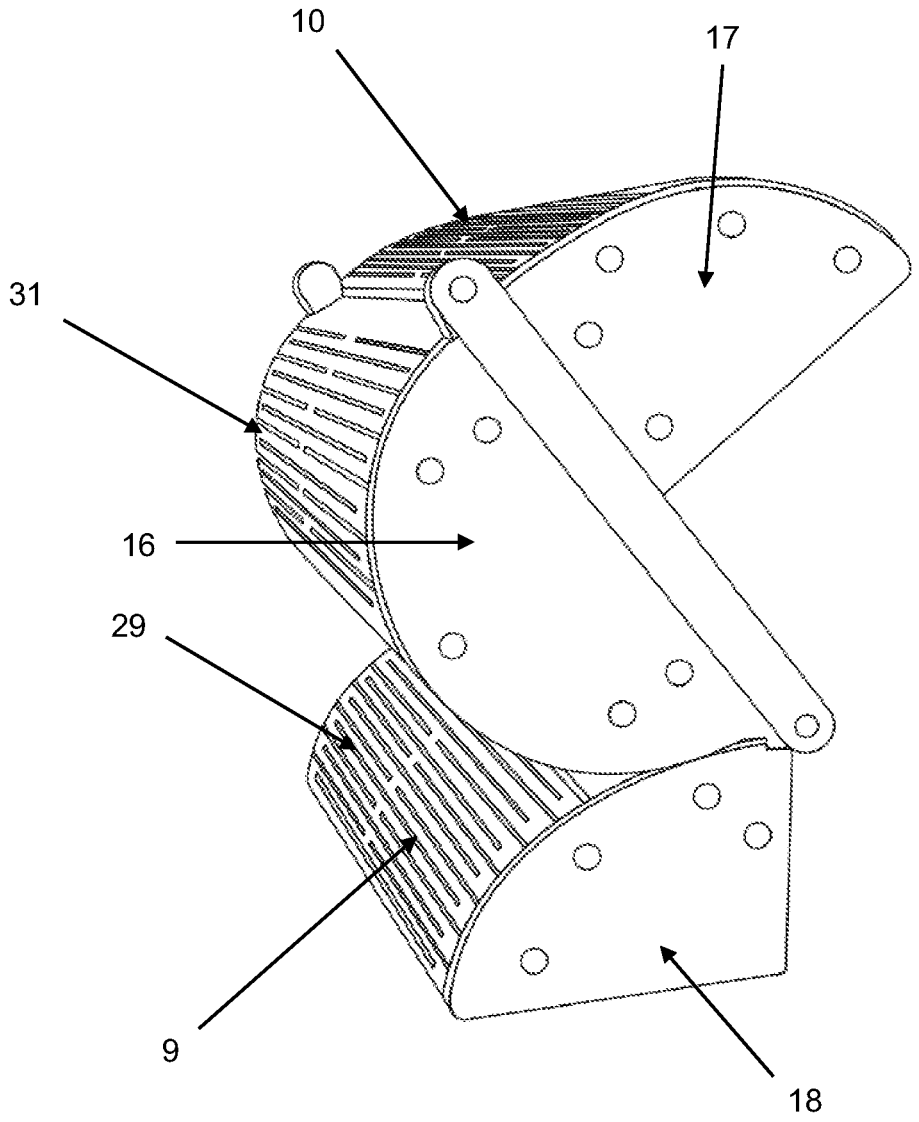
FIG. 6 is a view of the multicompartment handbag with a patterned exterior material.

FIG. 6 shows the present invention with a number of the exterior surfaces manufactured from different materials. In this view, first clamshell end material 17, second clamshell end material 18 and base end material 16 are made from wood covered in leather. First clamshell material 9, second clamshell material 10 and base material 31 are made of patterned wood. The patterned wood is laser cut using a CNC cutting machine. The wood underlying the first clamshell end material 17, second clamshell end material 18 and base end material 16 is also cut using a wood router or laser cutter with directed by a CNC machine with the leather stretched over it by hand.

Patterned wood exterior material 29 can be used for any panels of the present invention, in this case it is either the first clamshell material 10 or second clamshell material 9. Additionally lucite may be patterned in the same way as wood to be used as a functional and decorative exterior material.

Another embodiment of the bag can be manufactured with a first clamshell material 10 made of leather (over a wood base). The leather material is cut and stretched over the wood by hand. First clamshell end material 17, second clamshell end material 18 and base end material 16 are made of patterned plastic cut by a laser cutting attachment to a CNC machine.

A further embodiment of the bag may be manufactured with a first clamshell material 10, second clamshell material 9 and base material 31 made of metal, in this case lightweight bright aluminum sheets cut by a laser cutting attachment to a CNC machine. First clamshell end material 17, second clamshell end material 18 and base end material 16 are made of leather cut stretched by hand over a wood base cut with a wood router for a CNC machine.

Figure 7:
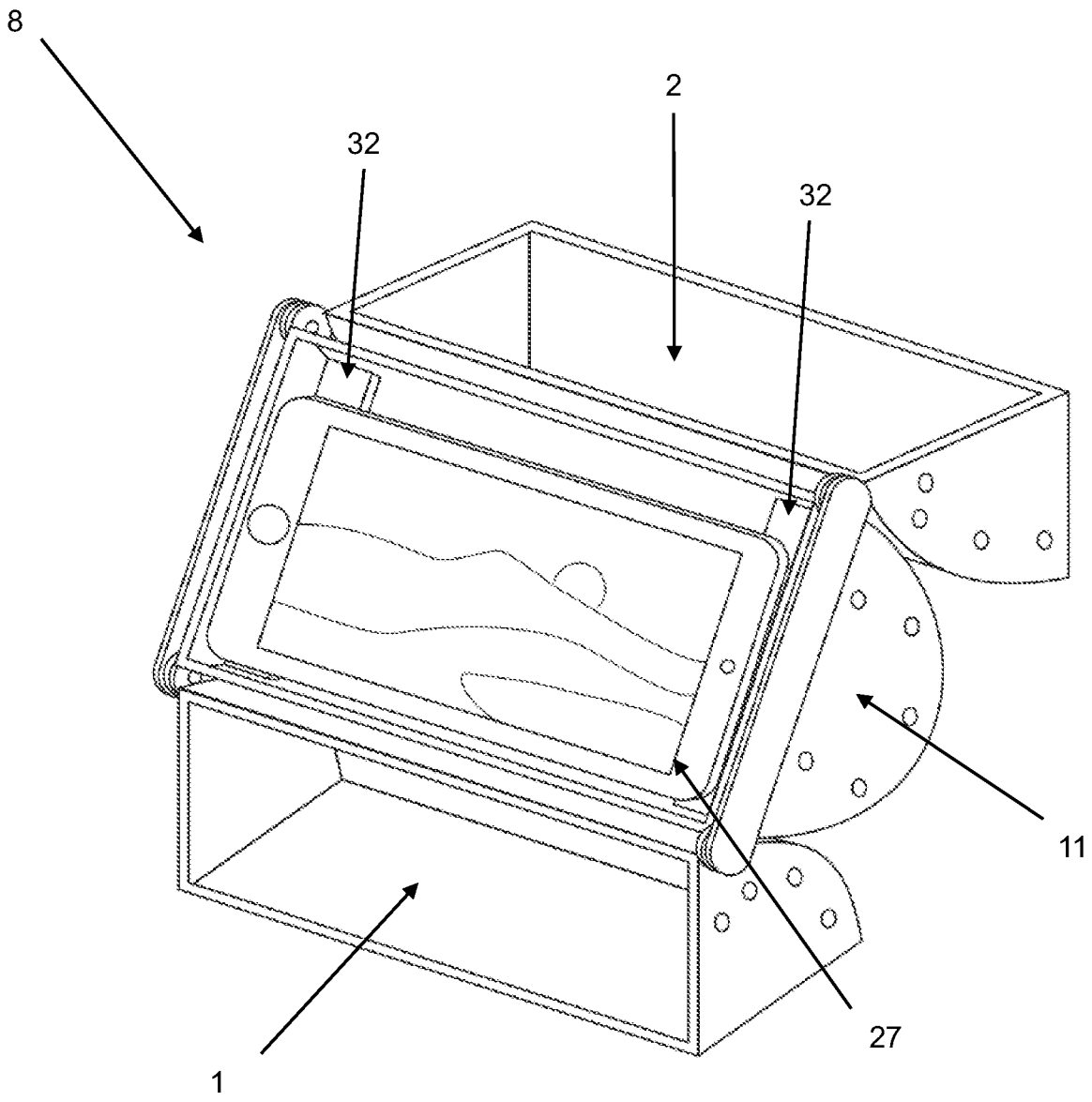
FIG. 7 is a view of the multicompartment handbag in the phone viewing configuration.

FIG. 7 shows a view of the multicompartment handbag 8 in a configuration designed to allow viewing of videos on phone 27. In this phone viewing mode, multicompartment handbag 8 is supported by first clamshell 1 folded under base 11. Second clamshell 2 is open to allow clear viewing of phone 27, which is resting on phone rails 32. Second clamshell 2 also provides balance for the device as it sits in this mode. The angle at which base 11 sits when resting on first clamshell 1 provides an optimum viewing angle on a supported phone 27 when multicompartment handbag 8 is resting on a table, desk or airline tray table. While first clamshell 1 is shown supporting the phone viewing mode in this figure, second clamshell 2 may be used in exactly the same way.

While not shown in the figures, a number of other decorations are anticipated by the invention either on the exterior or interior of the bag. These include adding patterns, logos or initials via laser cutting, scoring with a laser cutter, stamping, engraving, embossing, embedding precious stones, beads or rocks, painting, or carving.

While the bag presented here is sized to be carried as a handbag, it's anticipated that bags with the same features could be manufactured in larger sizes for weekend or overnight travel. The scope of this invention is not limited by the size of the bag described herein.

Although the present invention has been described in relation to the above disclosed preferred embodiment, many modifications in design, materials and manufacturing are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. A multicompartment handbag comprising:

a base with a base exterior material, the base comprising an area for storage, the area for storage comprising two vertical end walls, each vertical end wall having a flat end and a curved end, and a curved lateral wall that connects with the curved ends of the two vertical end walls to form the area for storage, the base further comprising an open top;

a first clamshell with a first clamshell exterior material, the first clamshell attached to the base by a first hinge, the first clamshell being configured to cover a portion of the open top of the base and to selectively open and close the open top of the base, the first clamshell rotating axially around the first hinge, the first clamshell further comprising a first clamshell storage compartment with a first clamshell storage compartment door for selectively opening and closing the first clamshell storage compartment and a first clamshell storage sleeve attached to the first clamshell;

a second clamshell with a second clamshell exterior material, the second clamshell attached to the base by a second hinge, the second clamshell being configured to cover a portion of the open top of the base and to selectively open and close the open top of the base, the second clamshell rotating axially around the second hinge, the second clamshell further comprising a second clamshell storage compartment with a second clamshell storage compartment door for selectively opening and closing the second clamshell storage compartment and a second clamshell storage sleeve attached to the first clamshell;

the first clamshell and second clamshell, when selectively closed, completely covering the open top of the base;

a first phone support and a second phone support, the first phone support and the second phone support configured to support a mobile phone over the open top of the base;

and a latch to secure the first clamshell to the second clamshell when the first clamshell and second clamshell are selectively closed over the open top of the base.

2. The multicompartment handbag of claim 1, where the base exterior material, the first clamshell exterior material and the second clamshell exterior material are made from the same material.

3. The multicompartment handbag of claim 1, where the base exterior material, the first clamshell exterior material and the second clamshell exterior material are made from different materials.

4. The multicompartment handbag of claim 1, where the base exterior material is selected from the group consisting of leather, man-made leather, woven leather, wood, patterned wood, wood veneer, plastic, Lucite, acrylic, resin, metal, washi paper, paper, shearling, enamel, aerospace grade aluminum, rattan, and alligator skin.

5. The multicompartment handbag of claim 1, where the first clamshell exterior material is selected from the group consisting of leather, man-made leather, woven leather, wood, patterned wood, wood veneer, plastic, Lucite, acrylic, resin, metal, washi paper, paper, shearling, enamel, aerospace grade aluminum, rattan, and animal skin.

6. The multicompartment handbag of claim 1, where the first clamshell exterior material is selected from the group consisting of leather, man-made leather, woven leather, wood, patterned wood, wood veneer, plastic, Lucite, acrylic, resin, metal, washi paper, paper, shearling, enamel, aerospace grade aluminum, rattan, and animal skin.

7. The multicompartment handbag of claim 1, where the second clamshell exterior material is selected from the group consisting of leather, man-made leather, woven leather, wood, patterned wood, wood veneer, plastic, Lucite, acrylic, resin, metal, washi paper, paper, shearling, enamel, aerospace grade aluminum, rattan, and alligator skin.

8. The multicompartment handbag of claim 1, where the base material is selected from the group consisting of wood, paper, plastic, Lucite, acrylic, and metal.

9. The multicompartment handbag of claim 1, where the first clamshell material is selected from the group consisting of wood, paper, plastic, Lucite, acrylic, and metal.

10. The multicompartment handbag of claim 1, where the second clamshell material is selected from the group consisting of wood, paper, plastic, Lucite, acrylic, and metal.

11. The multicompartment handbag of claim 1, further comprising a removable phone bed.

12. The multicompartment handbag of claim 1, further comprising a battery located inside the handbag.

13. The multicompartment handbag of claim 1, further comprising a hinge bar connecting the first hinge and second hinge.

14. The multicompartment handbag of claim 1, further comprising the base having a base interior material, the first clamshell having a first clamshell interior material and the second clamshell having a second clamshell interior material.

15. The multicompartment handbag of claim 14, where the base interior material is selected from the group consisting of leather, suede, velvet, fabric, micro suede, microfiber, alcantara, and plastic.

16. The multicompartment handbag of claim 14, where the first clamshell interior material is selected from the group consisting of leather, suede, velvet, fabric, micro suede, microfiber, alcantara, and plastic.

17. The multicompartment handbag of claim 14, where the second clamshell interior material is selected from the group consisting of leather, suede, velvet, fabric, micro suede, microfiber, alcantara, and plastic.

18. The multicompartment handbag of claim 1 further comprising a phone bed that supports the mobile phone over the first phone support and second phone support and a battery.

19. The multicompartment handbag of claim 18 where the battery is connected to the mobile phone using wireless charging means.

* * * * *